United States Patent [19]

Long et al.

[11] Patent Number: 5,066,345

[45] **Date of Patent: * Nov. 19, 1991**

[54] APPARATUS AND METHOD FOR SPLICING WEBS OF INDETERMINATE LENGTH

[75] Inventors: Michael Long; Lyndon R. Huttemann, both of Rochester; Robert W. Sanford, Wyoming, all of N.Y.; Robert D. Longboat, Ohsweken, Canada

[73] Assignee: Eastman Kodak Company, Rochester, N.Y.

[ * ] Notice: The portion of the term of this patent subsequent to Nov. 19, 2008 has been disclaimed.

[21] Appl. No.: 471,159

[22] Filed: Jan. 26, 1990

[51] Int. Cl.[5] ..... B31F 5/00; B65H 21/00

[52] U.S. Cl. ..... 156/157; 156/159; 156/505; 156/506; 156/519

[58] Field of Search ..... 156/157, 354, 506, 505, 156/520, 519, 521, 507, 159

[56] References Cited

U.S. PATENT DOCUMENTS

| | | | |
|---|---|---|---|
| 2,822,046 | 2/1958 | Krueger | 225/11 X |
| 2,973,890 | 3/1961 | Krueger | 225/43 |
| 3,245,861 | 4/1966 | Roshkind | 156/505 |
| 3,939,032 | 2/1976 | Taitel et al. | 156/505 |
| 3,957,570 | 5/1976 | Helm | 156/519 |
| 4,106,974 | 8/1978 | Hirsch | 156/507 X |
| 4,234,365 | 11/1980 | Shimizu et al. | 156/157 X |
| 4,328,066 | 5/1982 | Kiuchi et al. | 156/157 X |
| 4,385,959 | 5/1983 | Goguen | 156/506 |
| 4,421,587 | 12/1983 | Guenther et al. | 156/521 X |
| 4,462,858 | 7/1984 | Goguen et al. | 156/506 |
| 4,475,970 | 10/1984 | Farrow et al. | 156/159 |
| 4,478,674 | 10/1984 | Clark | 156/506 X |
| 4,497,454 | 2/1985 | Woodley | 242/56 R |
| 4,501,630 | 2/1985 | Kiuchi | 156/159 |
| 4,599,130 | 7/1986 | Woodley | 156/519 X |
| 4,682,742 | 7/1987 | Woodley et al. | 242/56 R |
| 4,692,531 | 9/1987 | Algierie et al. | 548/193 |
| 4,826,561 | 5/1989 | Carroll | 156/520 X |
| 4,848,691 | 7/1989 | Muto et al. | 242/58.1 |
| 4,858,841 | 8/1989 | Woodley et al. | 242/56 R |
| 4,878,982 | 11/1989 | Ogata et al. | 156/351 |
| 4,878,986 | 11/1989 | Nishikawa | 156/504 |
| 4,925,520 | 5/1990 | Beaudoin et al. | 156/521 X |

FOREIGN PATENT DOCUMENTS

| | | |
|---|---|---|
| 58-205966 | 7/1983 | Japan . |
| 63-316860 | 9/1988 | Japan . |
| 2112748 | 7/1983 | United Kingdom . |

*Primary Examiner*—David A. Simmons
*Assistant Examiner*—J. Sells
*Attorney, Agent, or Firm*—Charles E. Snee

[57] ABSTRACT

An apparatus and method are disclosed for splicing webs (14,18) such as photographic film in which the lead end of a new web and the tail end of an old web are trimmed at the parallel edges (82,84) of their input platens (36,38) and then shifted into abutment for application of a strip of tape. An automatic tape dispenser (128) cuts tape into predetermined lengths, transfers the lengths to a vacuum applicator wheel (130) and then rolls the lengths across the abutted lead and tail ends.

14 Claims, 14 Drawing Sheets

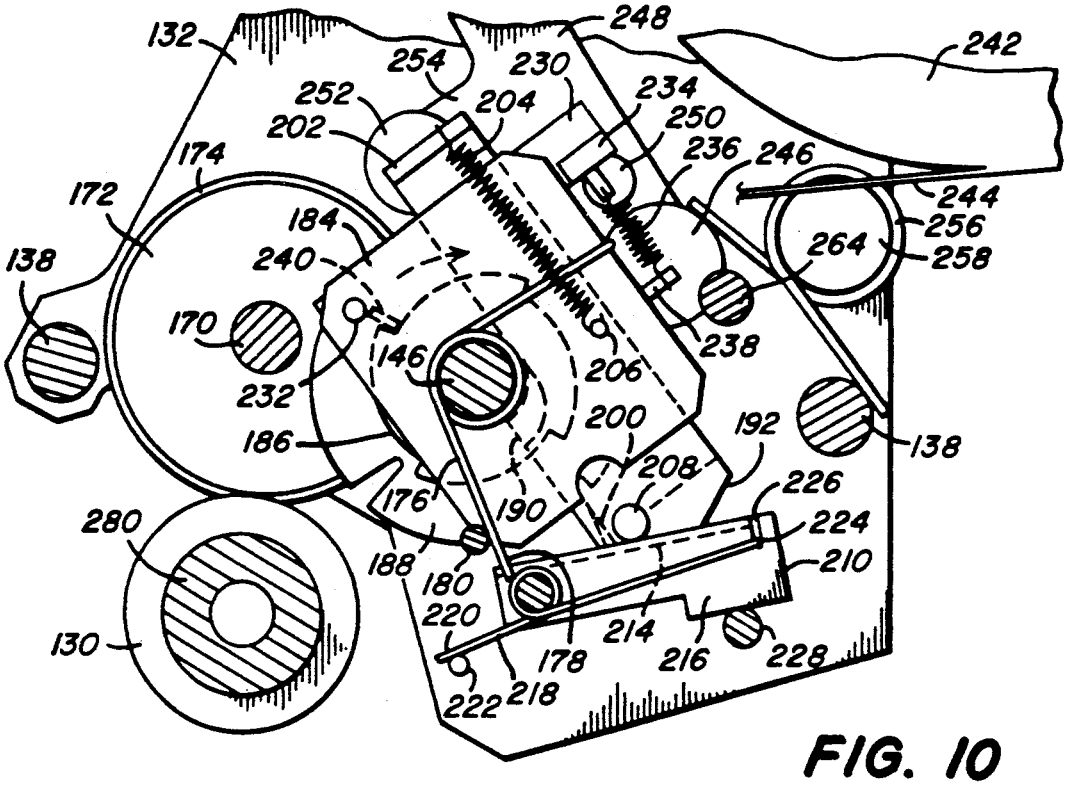
FIG. 10
FIG. 11
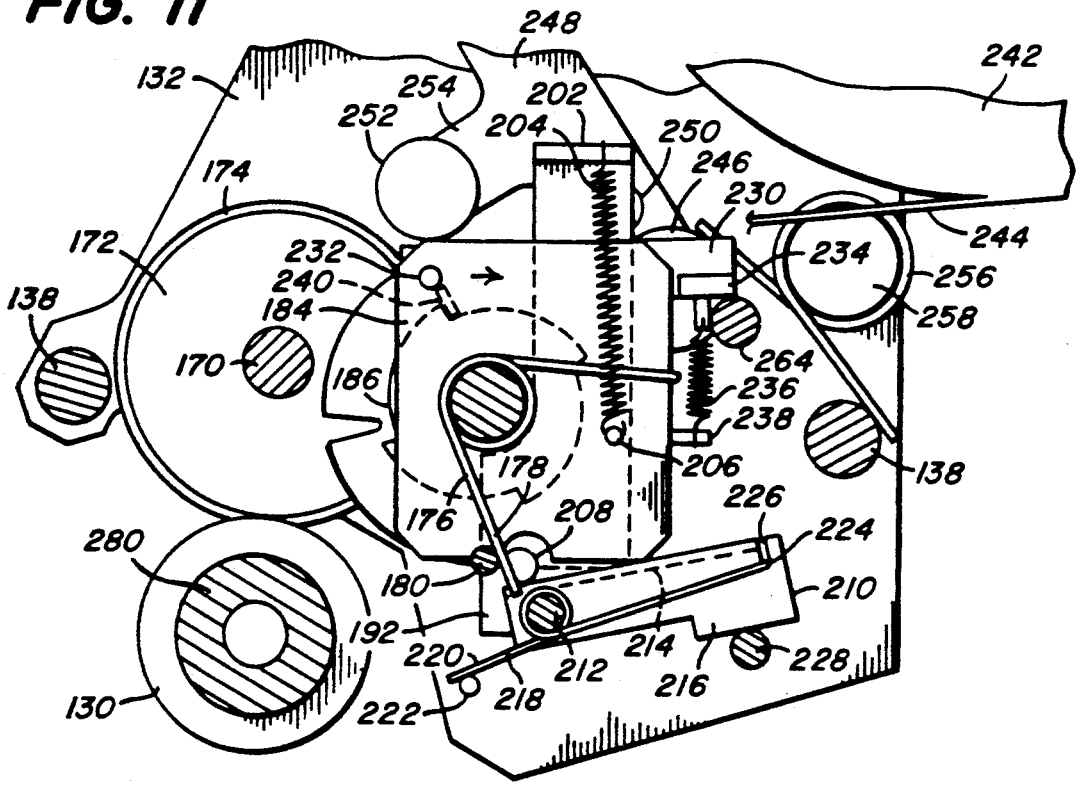

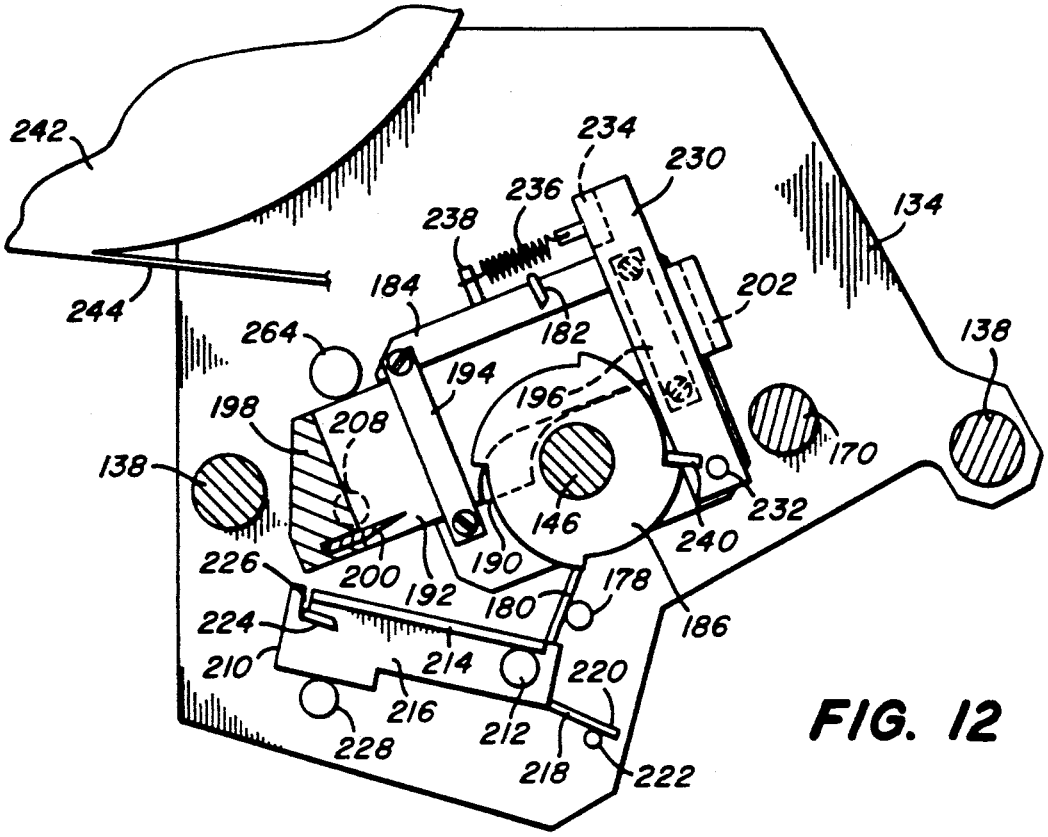
FIG. 12
FIG. 13
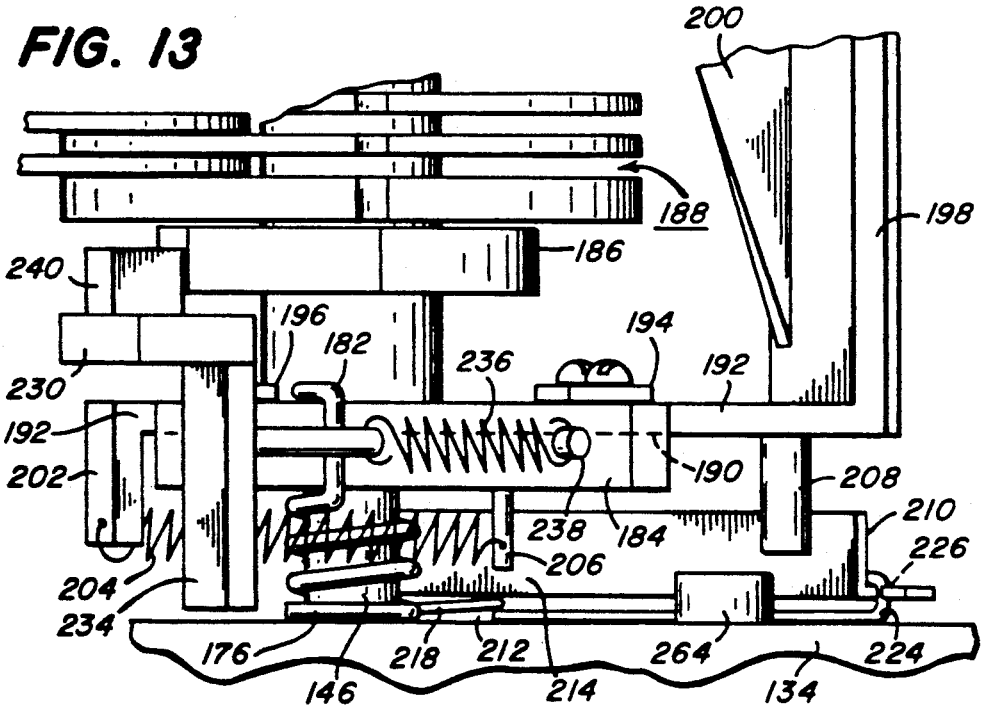

FIG. 14
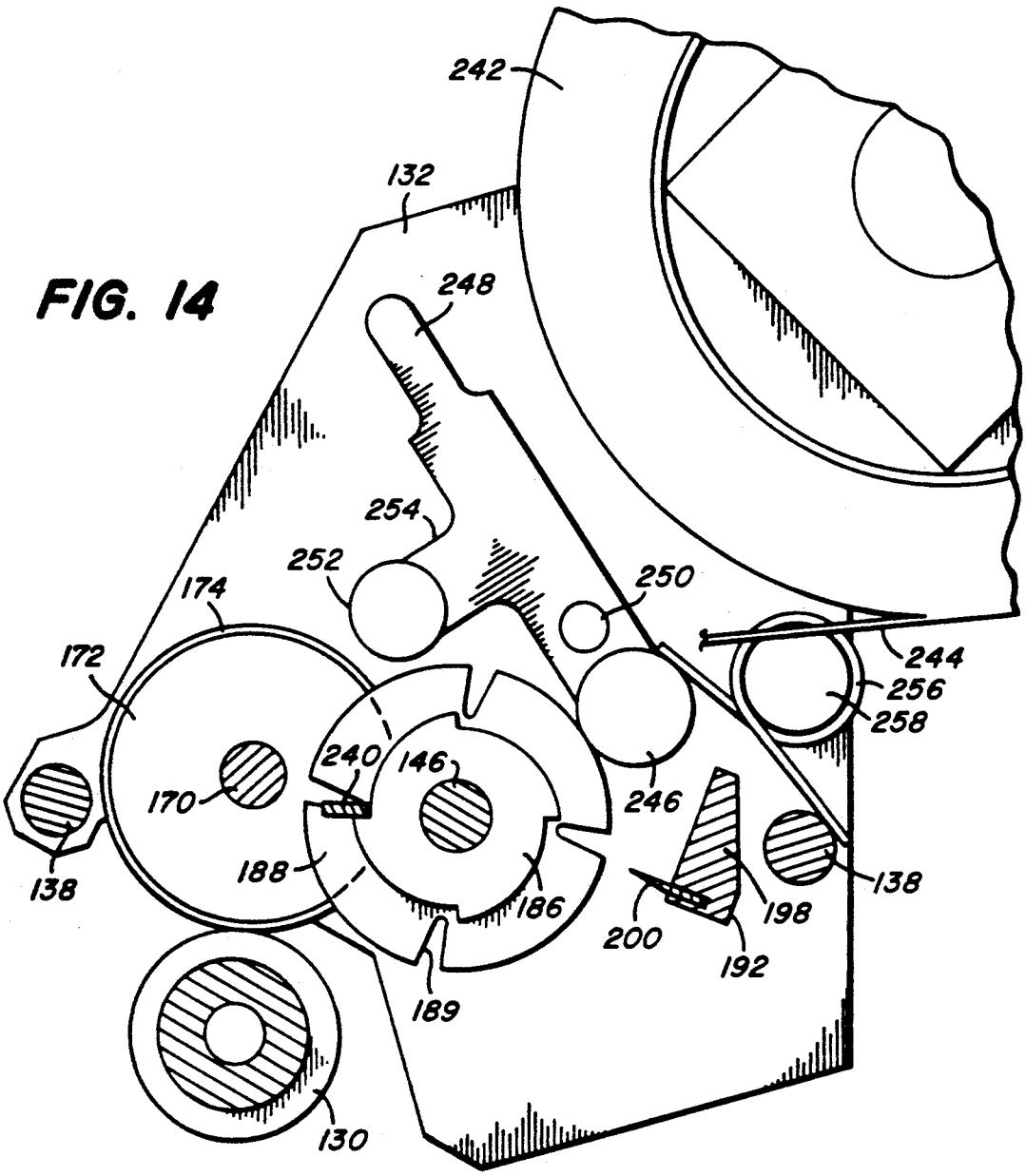
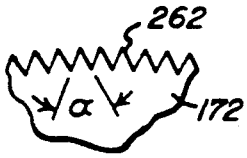
FIG. 14A
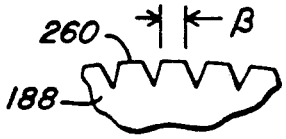
FIG. 14B

APPARATUS AND METHOD FOR SPLICING WEBS OF INDETERMINATE LENGTH

TECHNICAL FIELD

The present invention concerns an apparatus and a method for splicing webs of indeterminate length. More particularly, the invention concerns such apparatus and method in which the tail end of a preceding or old length of web and the lead end of a following or new length of web are trimmed, the trimmed ends are abutted and then are joined by applying a strip of adhesive tape to complete the splice.

BACKGROUND ART

Over the years many apparatus and methods have been developed for joining ends of flexible, strip like materials such as paper, plastic films, metal foils, photographic film strips and the like, which are collectively referred to in this specification as webs of material. The ends of such webs have been joined by overlapped joints with glue or thermal fusion and by butt joints with tape, for example. The apparatus and methods used have been manual, automatic and combinations of the two and have enjoyed widely varying degrees of success.

For example, U.S. Pat. No. 3,245,861 discloses a web splicer for use in label printing equipment in which the lead end of the following or new length of web is manually trimmed and a length of tape is applied across the trimmed end. The preceding or old length of web is then stopped as its source spool is emptied and its tail end is trimmed. The new lead end and applied strip of tape are then pressed against the old tail end to form an overlapping joint. Such overlapping joints are acceptable in many industrial applications but present problems during subsequent handling of the web in other applications. U.S. Pat. No. 3,939,032 discloses a web butt splicer in which the new lead end is trimmed manually and a length of tape is applied across the lead end. The old tail end is then trimmed at the same location and the two trimmed ends are pressed together to form a butt joint. U.S. Pat. No. 4,234,365 shows a web butt joining system in which the old web and the new web are threaded between a pair of cutting wheels which trim their ends and convey the two ends in abutment to a pair of tape applicator wheels which place strips of tape on both sides of the butt joint.

U.S. Pat. No. 4,501,630 discloses an apparatus for splicing a leader to magnetic tape in which the leader and tape are fed along parallel, coplanar guide grooves in a receiving table which is movable transversely to permit either the leader or the tape to move into a coplanar guide groove on an adjacent receiving table. After the lead end of the tape and the tail end of the leader have been trimmed in separate operations, the two ends are abutted and a strip of tape is applied. U.S. Pat. No. 4,629,531 shows an apparatus for joining sheet ends such as might be used in a newspaper printing plant. The new web is stopped and trimmed manually, after which glue is applied to its lead end. Then the old web is stopped and trimmed, after which the lead end of the new web is overlapped with the tail end of the old web. U.S. Pat. No. 4,801,342 discloses a method and an apparatus for forming a butt splice in which the old web and the new web are run along opposite sides of a planar cutting anvil along whose edge cutting wheels are run to trim the lead and tail ends, after which a strip of tape is rolled over the abutted ends.

Splicers of the types shown in these patents typically require intervention by the operator for steps such as trimming the lead or tail ends or applying tape strips to applicator wheels or to the trimmed ends. While this type of operator involvement is acceptable in many applications, certain high speed web handling operations, such as the spooling of photographic film, are slowed undesirably. Particularly when the web handling must take place in the dark, as in photographic applications, the operator's involvement can significantly slow the process.

A variety of tape applicator devices also have been used in splicers of the general sort just described. For example, U.S. Pat. No. 4,328,066 shows a tape splicer in which the tape is pulled onto a rotating vacuum drum which is translated into contact with the abutted ends to complete the splice, after which the vacuum drum is withdrawn to a position where the next strip can be cut. A separate roller is used to smooth out the splice. U.S. Pat. Nos. 4,475,970 and 4,478,674 show tape splicers in which the tape is cut to lengths on a square block and then press applied to the abutted ends. More recently, U.S. Pat. No. 4,848,691 shows a splicer in which the new web is trimmed, a strip of tape is applied to its trimmed end and then the trimmed end and tape are pressed into a lap joint with the still moving old web.

Other types of tape dispensers also have been used extensively. One type, manufactured by the 3M Company, uses knurled disks to move the tape through the dispenser. The operator depresses a ratcheting crank which turns the knurled disks to meter the tape, after which the operator must cut the tape against an adjacent serrated blade. Another type of dispenser, also made by the 3M Company, meters and cuts the tape by means of a metering wheel whose periphery comprises a series of raised ribs which contact the sticky side of the tape. Between these ribs are recesses large enough to permit the operator to insert a finger to peel away a cut strip after a plunge type knife has severed the tape near the preceding rib. In still another type of dispenser, the free end of a tape is pushed through the throat of a guillotine type cutter, which can lead to stubbing of the tape and improper operation of the dispenser.

SUMMARY OF THE INVENTION

The primary objective of this invention is to provide a method and apparatus for splicing webs of material in which operator interaction would be limited to replacement of the sources of web and splicing tape as they are consumed.

A further objective of this invention is to provide such a method and apparatus which automatically trims the ends of the old and new webs and abuts them for application of a strip of splicing tape.

Another objective of this invention is to provide such a method and apparatus which will automatically complete the splice in a matter of seconds without intervention by the operator.

Yet another objective of this invention is to provide such a method and apparatus which will ensure proper registration of edge perforations between new and old webs.

Still another objective of this invention is to provide such an apparatus which is modular and can be relatively simply installed in place of existing splicing equipment.

Still another objective of this invention is to provide such an apparatus and method which can splice with single or double sided tape with little sensitivity to the degree of stickiness of the tape, the flexibility of the tape support or the tendency of the support to curl.

These objectives are given only by way of illustrative examples; thus, other desirable objectives and advantages inherently achieved by the disclosed invention may occur or become apparent to those skilled in the art. Nonetheless, the scope of the invention is to be limited only by the appended claims.

In one embodiment of the invention, an apparatus is provided for trimming the tail end of a first length of web and the lead end of a second length of web and then placing such trimmed ends in abutment. A first input platen is provided for supporting the first length of web and a second input platen is provided for supporting the second length of web. The two platens have trailing edges which are parallel. Means are provided for selectively stopping movement of the first length of web across the input platen and for cutting the first and second lengths of web at the trailing edges of the platens. A process platen is positioned opposite the trailing edges; and means are provided for relatively moving the platens between a first position in which the process platen receives the first length of web from the first platen and a second position in which the process platen receives the second length of web from the second platen. Thus a trimmed end of web on one of the input platens may be abutted with a trimmed tail end of web on the process platen.

Preferably, the platens have perforated bed plates to facilitate application of vacuum to hold the webs during cutting or the passage of air to support the webs during movement. For use with webs having edge perforations, means are provided for registering the perforations of webs on the input platens with those of the web on the process platen. To ensure such registration, the webs are trimmed by a pair of blades which essentially simultaneously engage the webs at the trailing edges of the input platens.

In the method of abutting tail and lead ends of web in accordance with the invention, web is moved across one input platen and the process platen and on to subsequent process steps. Meantime, a new web is positioned on the other input platen. When the old web is nearly expired, its movement across the one input platen is stopped. Then, the tail end of the old web and the lead end of the new web are trimmed, after which the tail and lead ends are moved into abutment in preparation for application of a strip of tape.

The apparatus for cutting and applying strips of tape in accordance with the invention comprises a first rotable drum means for drawing a web of tape from a suitable source. Means adjacent the first drum cut the tape into predetermined lengths while the web is moving on the first drum. A second rotatable drum removes the lengths of tape from the first and passes them to a third tape applicator drum. Means are provided for translating the tape applicator drum away from the second drum and rolling the applicator drum along a surface to apply the lengths of tape. When such an apparatus is combined with the structure described in the preceding paragraphs, the lengths of tape are applied across the abutted ends of the old and new webs.

In the preferred embodiment of the apparatus for applying lengths of tape, the first and second drums each comprise a plurality of circular disks mounted for rotation, the edges of the disks being interleaved so that lengths of tape of the first drum are transferred to the second. Preferably, the edges of the disks of the two drums are knurled to control the degree of adhesion of the tape to the drums, the adhesion to the first drum being substantially greater than that to the second drum; and the second drum has a substantially higher peripheral velocity to facilitate transfer of the strips. The applicator drum preferably is vacuum actuated and rotated with a somewhat higher peripheral velocity than the second drum, to remove the cut lengths of tape easily from the second drum. Because the tape is metered out and cut while it maintains contact with the knurled surface of the first drum and is peeled free only when needed, the usual difficulties of advancing the free end of a sticky tape are avoided.

In the method for cutting and applying lengths of tape in accordance with the invention, the lengths of tape are cut on the first drum and them removed sequentially by the second drum and passed to the rotating vacuum drum. The vacuum drum is then translated away from the second drum and rolled along a surface to apply the lengths of tape to such surface. When this method is combined with the previously described method for abutting tail and lead ends, the lengths of tape are rolled across the abutted ends to complete the splice.

BRIEF DESCRIPTION OF THE DRAWINGS

The foregoing and other objectives, features and advantages of the invention will be apparent from the following more particular description of the preferred embodiments of the invention, as illustrated in the accompanying drawings, in which:

FIG. 10 shows a view taken along line 9—9 of FIG. 6, illustrating the plunge knife carrier in its partially inserted position.

FIG. 11 shows a view taken along line 9—9 of FIG. 6, illustrating the plunge knife carrier in its fully inserted position.

FIG. 12 shows a view taken long line 12—12 of FIG. 6, illustrating the plunge knife carrier in its fully withdrawn position.

FIG. 13 shows a further enlarged, fragmentary top plan view of the apparatus of FIG. 5.

FIG. 14 shows a view taken along line 14—14 of FIG. 6, illustrating the plunge knife carrier in its fully withdrawn position.

FIG. 14A shows a fragmentary view of the type of knurling preferred for the peripheries of the disks forming the tape release drum.

FIG. 14B shows a fragmentary view of the type of knurling preferred for the peripheries of the disks forming the tape acquisition drum.

DESCRIPTION OF THE PREFERRED EMBODIMENTS

Figure 1:
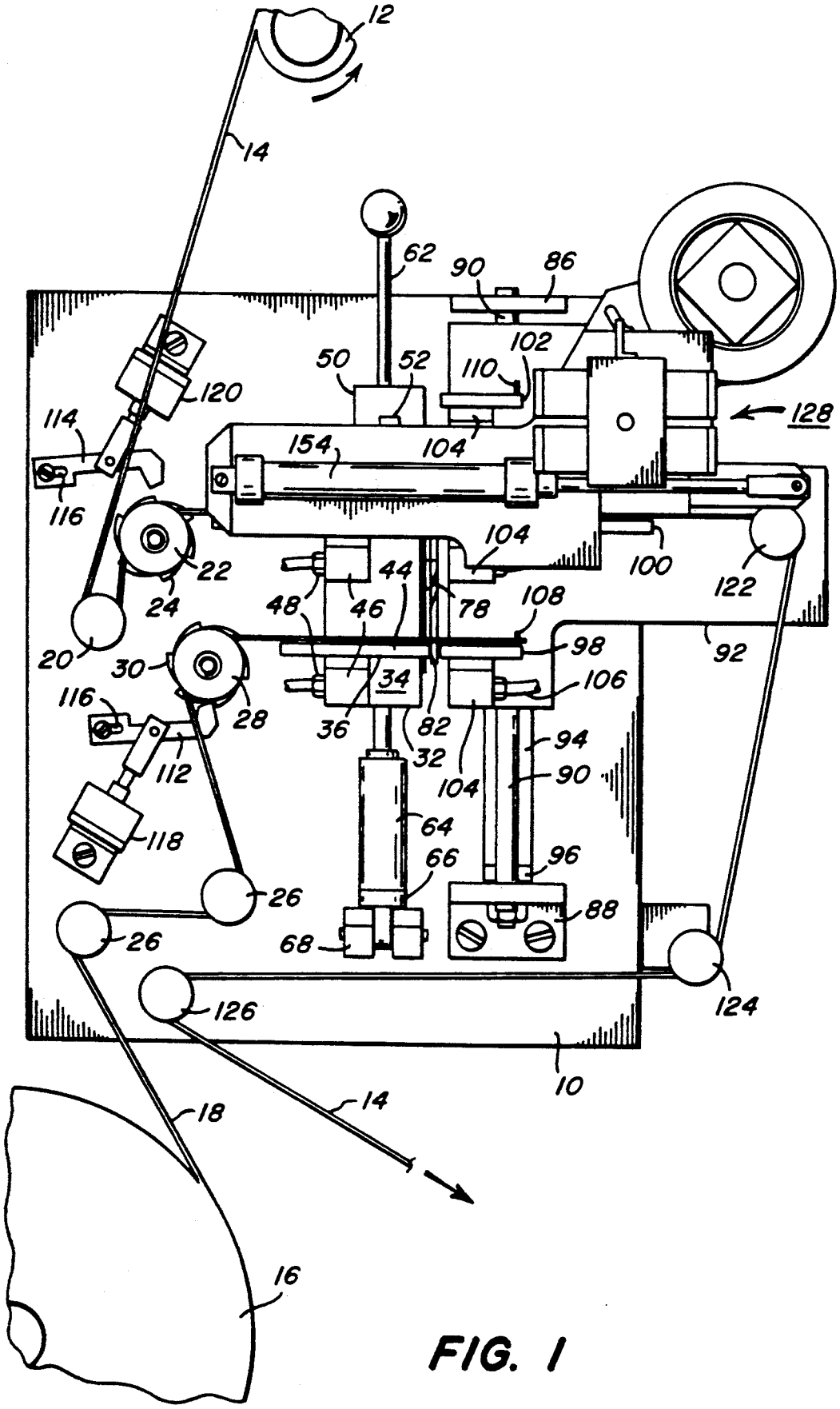
FIG. 1 shows a front elevation view of the apparatus according to the invention as configured when a web from an old, expiring roll is running through the splicer and a web from a new, waiting roll has been threaded in place for the next splicing operation.

The following is a detailed description of the preferred embodiments of the invention, reference being made to the drawings in which the same reference numerals identify the same elements of structure in each of the several Figures.

Referring simultaneously to FIGS. 1 to 4, the apparatus according to the invention is seen to comprise a rugged base plate 10 positioned preferably between an old or expiring roll or source 12 of web 14 of indeterminate length, such as conventional 35 mm photographic film having edge perforations, not illustrated; and a new or waiting spare roll or source 16 of web 18 also of indeterminate length, such a photographic film. Web 14 is threaded about a flanged roller 20 mounted for rotation on an axis perpendicular to base plate 10 and then over a flanged registration sprocket 22 aligned with roller 20. Sprocket 22 is attached to a ratchet wheel 24 and the assembly is mounted for rotation on an axis perpendicular to base plate 10. Similarly, web 18 is threaded about a pair of flanged rollers 26 mounted for rotation about axes perpendicular to base plate 10 and then over a flanged registration sprocket 28 aligned with rollers 26. Sprocket 28 is attached to a ratchet wheel 30 and the assembly is mounted for rotation on an axis perpendicular to base plate 10.

Laterally spaced from ratchet wheels 24 and 30 is an elongated U-shaped bracket 32 which is rigidly mounted to base plate 10 with the open end of the U facing to the right as illustrated in FIG. 1. As seen most clearly in FIG. 4, affixed to the front surface 34 of bracket 32 are a pair of vertically spaced, parallel vacuum input platens 36, 38. Optionally, to provide added alignment with registration sprockets 22,28, input platens may be provided with edge guides 40,42, shown only in FIG. 4 for ease of illustration. Guides 40,42 are aligned with the flanges on sprockets 22,28 to ensure that webs 14 and 18 will run straight and parallel across input platens 36,38. Preferably, input platens 36,38 comprise flat perforated bed plates 44 operatively connected to manifolds 46 which in turn are connected by suitable pneumatic fittings 48 to a conventional source of pressurized air or vacuum (not illustrated). Thus, when vacuum is applied to bed plates 44, webs 14,18 are held firmly in place; but when pressurized air is applied, the webs are supported on a cushion of air during movement across the bed plates.

Within bracket 32 is mounted a cutting knife carrier block 50 having on its front face a vertically extending spline 52 which slidably engages a vertical slot 54 extending into the inside surface of the front wall of bracket 52, as indicated in phantom lines. Carrier block 50 is provided in its rear surface with a vertically extending slot 56, as indicated in phantom lines, which slidably engages a vertically extending spline 58 provided on a flange 60 attached to a side wall of bracket 32. A handle 62 is provided for manually moving carrier block 50 up and down; however, such movement typically is provided in operation by a pneumatic cylinder 64 having its head end 66 pivotably attached to base plate 10 by means of a cylinder mount 68 and its rod end 70 pivotably attached to carrier block 50 by means of a flange 72. Attached to the vertical side of carrier block 50 exposed through the open end of U-shaped bracket 32 is a stiff metal plate 73 having a pair of vertically spaced, laterally extended and resilient arms 74,76 whose lower edges define a pair of cutting knives 78,80 having downwardly angled cutting edges. In the raised position shown in FIG. 4, the left hand vertical edge 81 of plate 73 below knife 80 and below knife 78 contacts the trailing edges 82,84 of input platens 36,38 to guide knives 78,80 and prevent their being stubbed as they are moved downward. Arms 74,76 support knives 78,80 so that the edges of the knives are pressed against trailing edges 82,84 as carrier block 50 moves downward to the position of FIG. 2, thus ensuring a clean cut of webs 14,18. In all positions of carrier block 50, trailing edges 82,84 are contacted by arms 74,76 or edge 81 to guide knives 78,80 smoothly over the trailing edges.

Positioned adjacent the knife carrier assembly just described are the movable output or process platens and the splicing tape applicator according to the invention. An upper bracket 86 and a lower bracket 88 extend forwardly from base plate 10 and rigidly support between them a vertically extending slide 90, illustrated only schematically, on which a rigid carrier plate 92 is mounted for movement upward and downward as viewed in FIGS. 1 to 3. Movement of carrier plate 92 between the positions of FIG. 1 and FIG. 3 is controlled by a pneumatic cylinder 94, shown positioned behind slide 90, whose head end 96 is attached to bracket 88 and whose rod end, not illustrated, is operatively connected to carrier plate 92. Mounted on the front face of carrier plate 92 is a lower trimmed end vacuum platen 98 which is directly opposite to and aligned with input platen 36 in the position of FIG. 1, but below input platen 36 in the position of FIG. 3. A central process vacuum platen 100 is mounted on the front face of carrier plate 92 directly above and parallel to trimmed end platen 98. Process platen 100 is directly opposite to and aligned with input platen 38 in the position of FIG. 1, but directly opposite to and aligned with input platen 36 in the position of FIG. 3. An upper trimmed end vacuum platen 102 is mounted on the front face of carrier plate 92 directly above and parallel to process platen 100. Trimmed end platen 102 is directly opposite to and aligned with input platen 38 in the position of FIG. 3, but above input platen 38 in the position of FIGS. 1 and 2. Each of platens 98,100,102 preferably includes a perforated bed plate similar to bed plates 44. To provide proper alignment with registration sprockets 22,28, each of platens 98,100,102 preferably comprises edge guides similar to guides 40,42 which optionally may be provided or input plates 36,38. As in the case of platens 36,38, manifolds 104 connect each platen 98,100,102 via suitable pneumatic fittings 106 to a conventional source of pressurized air or vacuum (not illustrated). Thus, when vacuum is applied to the bed plates, webs 14,18 are held firmly in place; but when pressurized air is applied, the webs are supported on a cushion of air during movement across the bed plates.

To facilitate threading the lead end from a new roll of web so that the edge perforations of the new web will be in registry with those of the old one, trimmed end platens 98,102 are provided at their trailing edges with pairs 108,110 of spaced locator pins for engaging the edge perforations in webs 14,18. The locator pins are positioned so that when perforations of the webs are placed over the pins, the following portions of the webs will also register with registration sprockets 22,30. Also to ensure that the new and old webs will be in proper registry, ratchet wheels 24,30 are provided, respectively, with latch pawls 112,114 having slotted pivots 116 attached to base plate 10 and pneumatic pawl actuator cylinders 118,120 pivotably attached between pawls 112,114 and base plate 10. In FIG. 1, pawl 112 is shown disengaged from ratchet wheel 24, thereby permitting old web 14 to pass over input platen 38 and process platen 100; whereas, pawl 114 is shown engaged with ratchet wheel 30, thereby restraining new web 18 from movement across input platen 36 and trimmed end platen 98.

Figure 2:
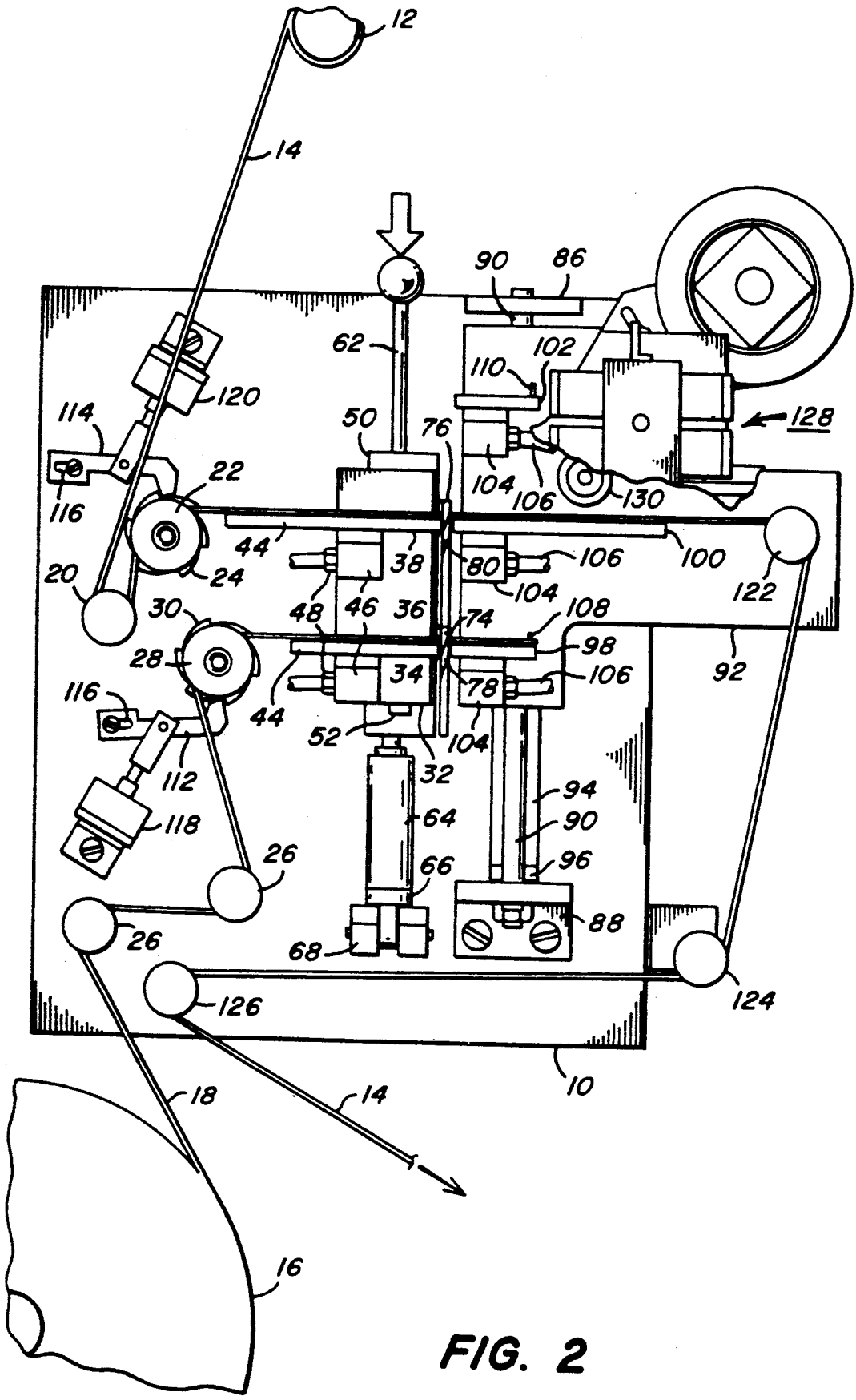
FIG. 2 shows a front elevation view of the apparatus according to the invention, with the splicing tape applicator shown only fragmentarily, as configured when the web from an old, expiring roll has been stopped and the cutting knife has been lowered to trim the tail end of the web from the old, expiring roll and the lead end of the web from the new, waiting roll.
Figure 3:
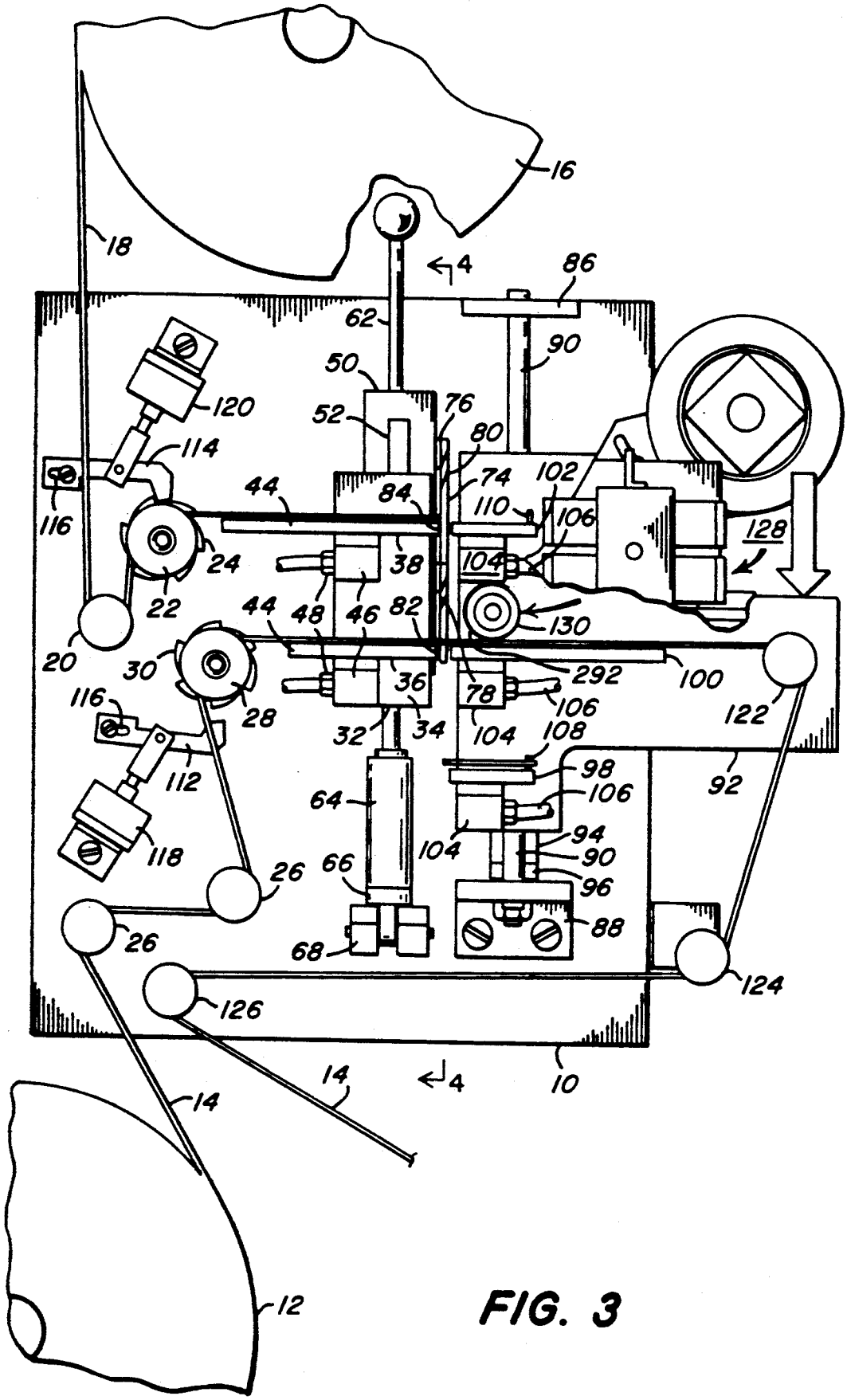
FIG. 3 shows a front elevation view of the apparatus according to the invention, with the splicing tape applicator shown only fragmentarily, as configured when the cutting knife has been raised again to the position of FIG. 1 and the tape applicator carriage has been lowered to align the tail end of web from the old, expired roll with the lead end of the new, waiting roll, just as the strip of splicing tape is about to be rolled over the butted lead and tail ends.
Figure 4:
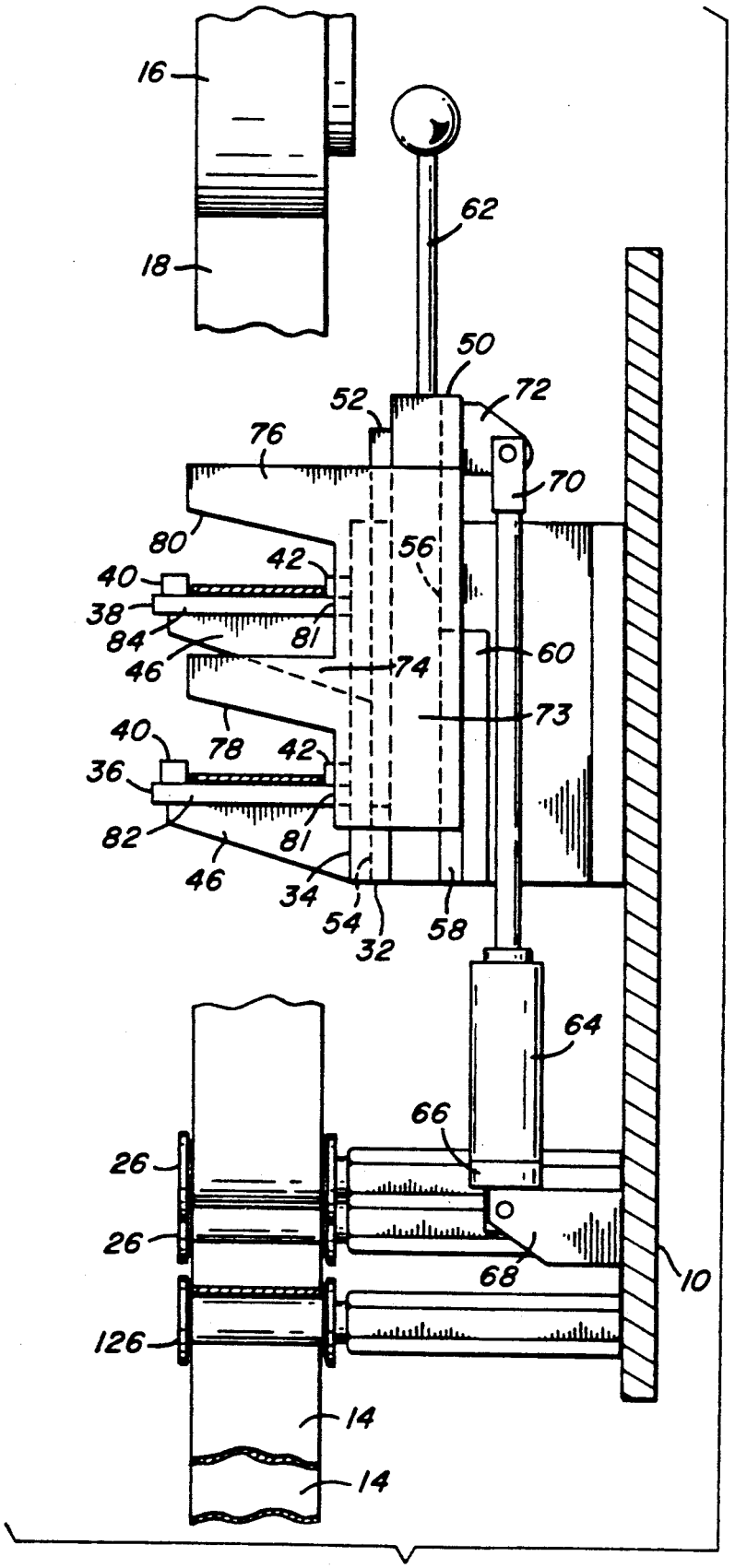
FIG. 4 shows a sectional view taken along line 4—4 of FIG. 3, illustrating details of the actuator for the cutting knife.

In operation of the structure thus far described, as seen in FIGS. 1 and 2, the old web 14 is drawn from roll 12, around flanged roller 20, around free-wheeling flanged registration sprocket 22, across input platen 38 and process platen 100, around flanged rollers 122,124,126 and on to subsequent processing equipment. To minimize scratching of web 14 as it moves, a flow of air is maintained through the bed plates of platens 38 and 100 to support the web during movement. Meantime, as seen in FIGS. 1 and 2, new roll 16 sits waiting with web 18 passed around flanged rollers 26, over stopped flanged registration sprocket 28, across input platen 36 and onto trimmed end platen 98 where one set of edge perforations is placed over locator pins 108. If desired, a vacuum may be applied through the bed plates of platens 36 and 98 to hold the lead end of web 18 in place. When roll 12 has nearly expired, as conventionally detected by sensors not illustrated, pneumatic cylinder 120 is actuated to engage pawl 114 with ratchet wheel 24, thereby bringing web 14 to a rapid but controlled stop. The arrangement of cylinder 120 and slotted pivot 116 of pawl 114 provides sufficient flexibility in the linkage to enable the inherent damping and compliance characteristics of the cylinder to stop the web without damage to its perforations. Also, registration sprockets 22 and 28 are positioned so that at trailing edges 82,84 of input platens 36,38, the edge perforations of webs 14,18 are in perfect registry when both webs are stopped.

Vacuum is then applied through the bed plates of platens 38,100 and 36,98 to hold webs 14,18 securely in place on their respective platens. Pneumatic cylinder 64 is then actuated to cause carrier block 50 to move downward to the position shown in FIGS. 2 and 4. This movement causes knife blades 78,80 to pass closely over trailing edges 82,84 to cleanly cut web 14 and trim the lead end of web 18, while leaving the edge perforations on the lead end of web 18 and those on the tail end of web 14 in registry. Cylinder 64 then raises the knife assembly back to the position of FIGS. 1 and 3.

While a vacuum is maintained on platens 38,100 and 36,98, pneumatic cylinder 94 is then actuated to lower carrier plate 92 to the position shown in FIG. 3. Thus, the trimmed tail end of the expiring web on process platen 100 now comes into alignment with the trimmed lead end of the new web on input platen 36. At the same time, as seen in FIG. 2, the remainder of the old web on input platen 38 and the trimmed end of the new web on platen 98 are ready for subsequent removal by the operator. Then, the splice tape dispenser and applicator 128 of the invention, to be described shortly, is actuated to extend its vacuum actuated, silicone rubber covered applicator roller 130 and roll a strip of tape across the abutted ends positioned between platens 36 and 100. Once the strip of tape has been rolled on and roller 130 has been rolled back over the joint to ensure good adhesion as roller 130 is withdrawn, the vacuum acting on platens 36,38,98,100 is released and a flow of air is established through the bedplates of platens 36,100, after which the freshly spliced web 14 may again be placed in motion.

The entire operation cycle just described can be accomplished in a second or two, thus yielding considerably reduced down times for splicing of webs, compared to most prior art splicing techniques, which may take a minute or so to complete a splice. After the newly spliced web has begun to move, the operator may return at any convenient time to remove the old roll and any remaining web plus the lead end trimmed from the new roll. A fresh roll 16 may then be installed and threaded onto the available input platen and trimmed end platen, as shown in FIG. 3. Thus, the new and expired rolls shift from one side to the other of the apparatus following each splicing cycle.

Figure 5:
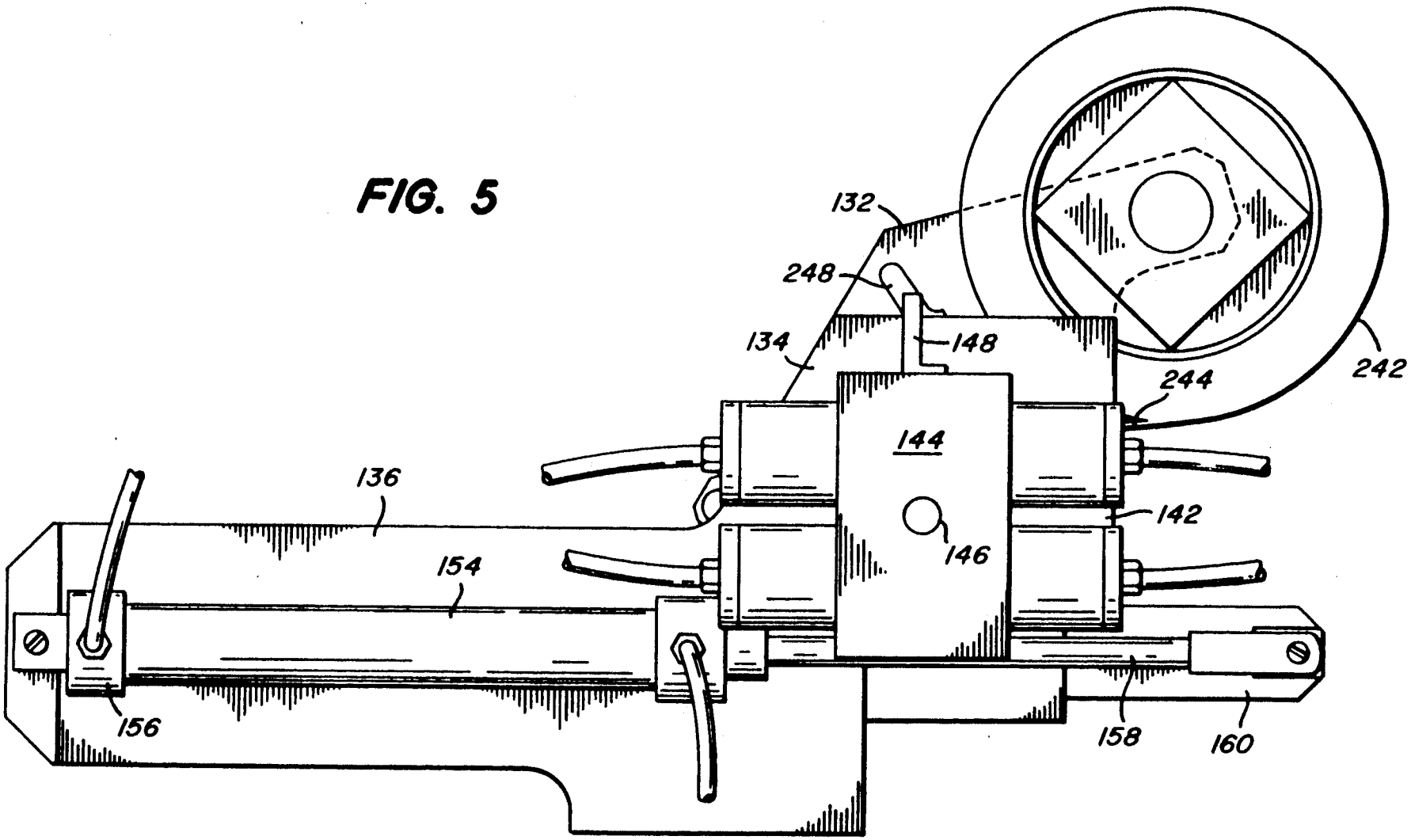
FIG. 5 shows an enlarged front elevation view of the splicing tape applicator according to the invention.
Figure 6:
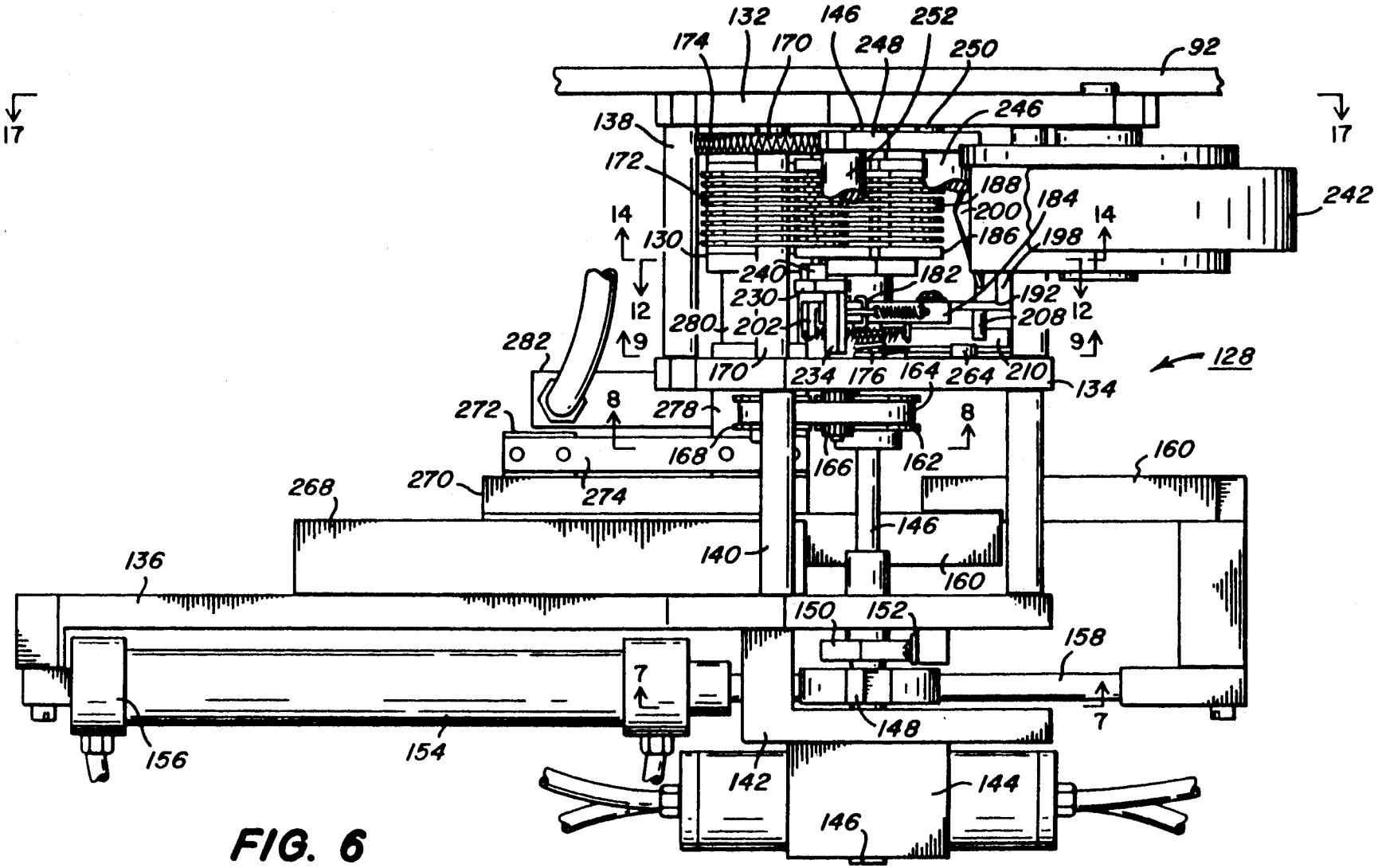
FIG. 6 shows an enlarged top plan view of the splicing tape applicator according to the invention.

Turning now to FIGS. 5 and 6, splice tape dispenser and applicator 128 may be seen to comprise a rugged frame made up of a back plate 132 which is rigidly attached to carrier plate 92 in a position to permit applicator roller 130 to roll across platen 100 and either platen 36 or platen 38 to complete the splice. The frame also comprises a center plate 134 and a laterally elongated front plate 136. Between plates 132 and 134, a plurality of spacers 138 are provided; and between plates 134 and 136, a plurality of spacers 140. On the front surface of front plate 136 is mounted an L-shaped bracket 142 to which a pneumatically driven motor 144 is attached. Motor 144 is operatively connected to drive shaft 146 for dispenser and applicator 128. Shaft 146 is journalled for rotation in rear plate 132, center plate 134 and front plate 136.

Figure 7:
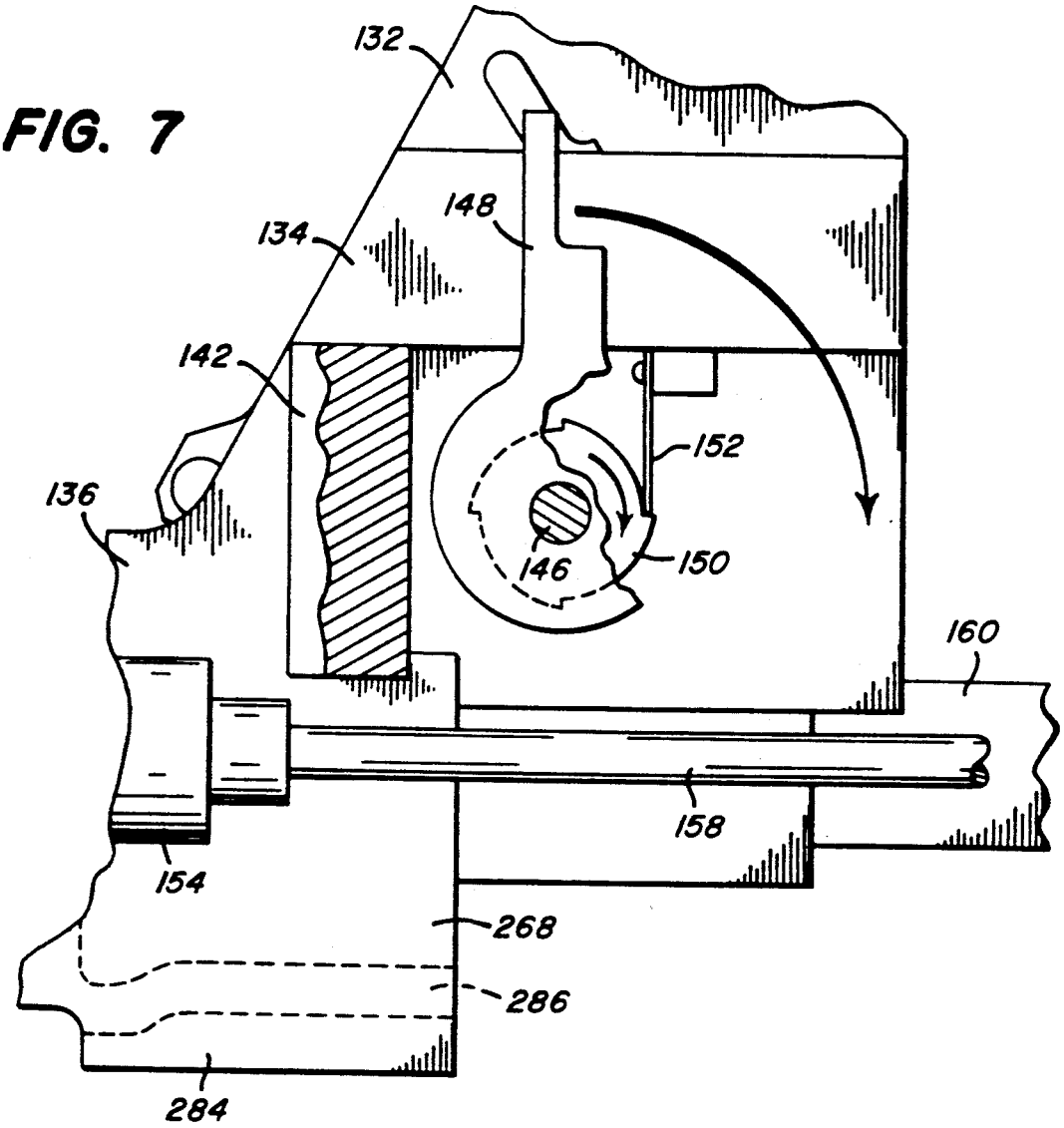
FIG. 7 shows a view taken along line 7—7 of FIG. 6.

As seen in FIG. 7, a manual indexing handle 148 is mounted on shaft 146 via a conventional overrunning clutch, not illustrated. A ratchet wheel 150 is fixed on shaft 146 to the rear of handle 148 and a leaf spring 152 is mounted on the front face of front plate 136 in position to function as a reverse rotation stop for ratchet wheel 150. Thus handle 148 may be rotated in the direction indicated as needed to index the overall mechanism, as would be needed, for example, when threading a new roll of tape.

Figure 17:
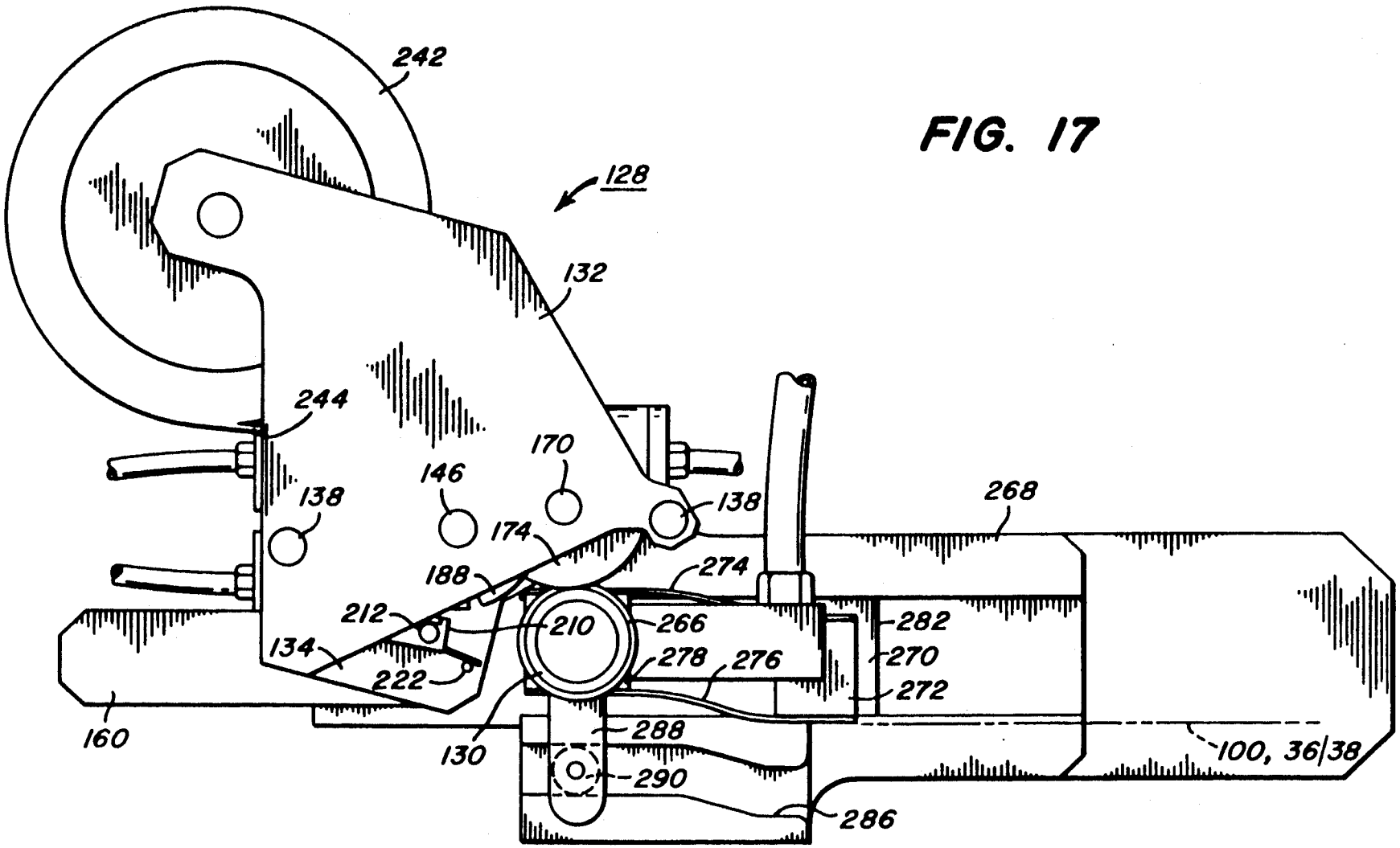
FIG. 17 shows a view taken along line 17—17 of FIG. 6, illustrating the splicing tape applicator drum in its fully retracted position.
Figure 18:
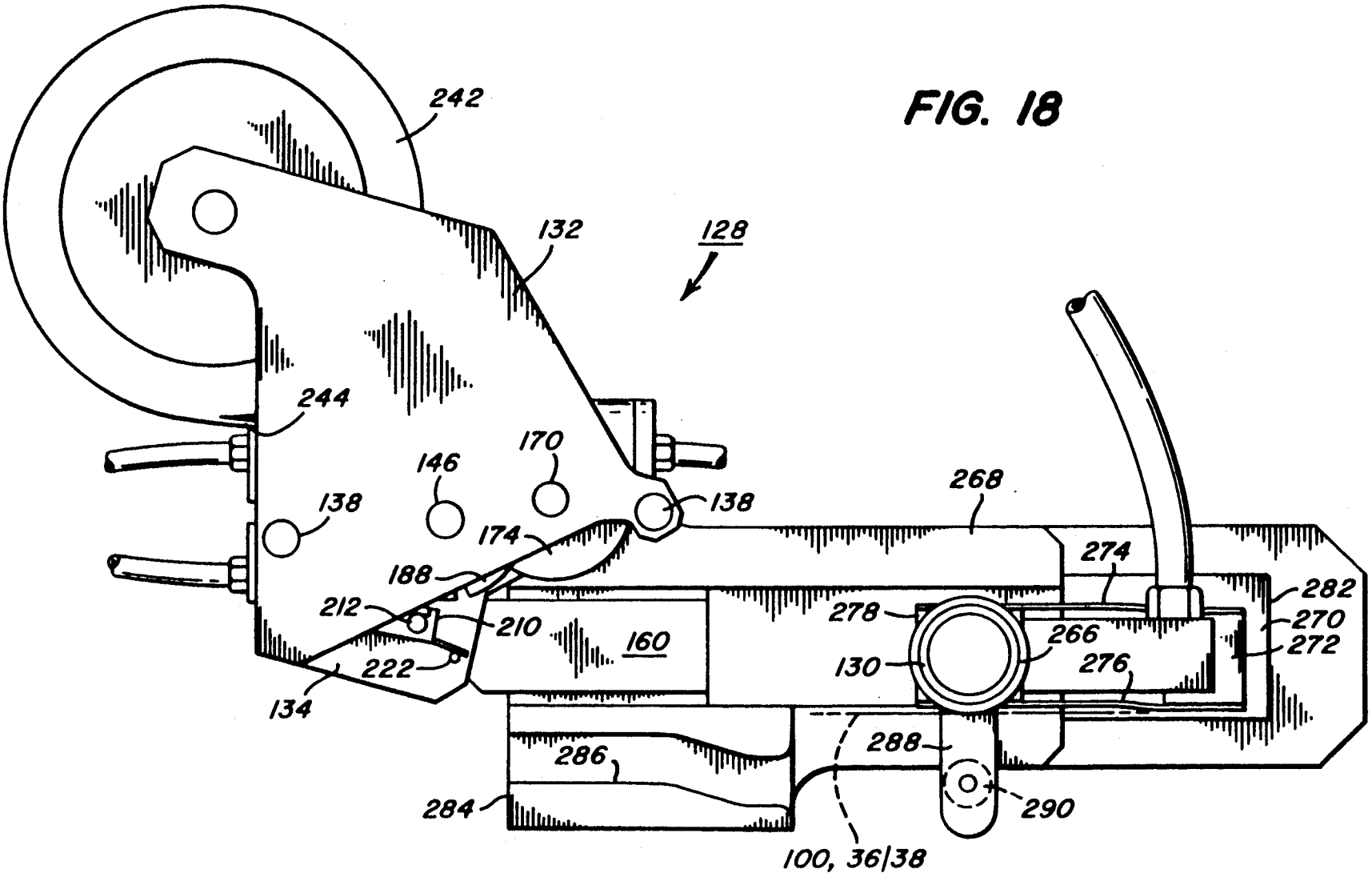
FIG. 18 shows a view taken along line 17—17 of FIG. 6, illustrating the splicing tape applicator drum in its fully extended and lowered position.

As shown in FIGS. 5, 6 and 7, a pneumatic cylinder 154 is mounted on the front surface of front plate 136 for the purpose of extending and retracting tape applicator wheel 130, as will be discussed in more detail shortly. Cylinder 154 is attached to front plate 136 by means of a pivot at the head end 156 of the cylinder. The actuator 158 of cylinder 154 passes beneath indexing handle 148 and is pivotably attached to the outboard end of a slidable carrier 160 on which applicator roller 130 is mounted, as best seen in FIGS. 17 and 18.

Figure 8:
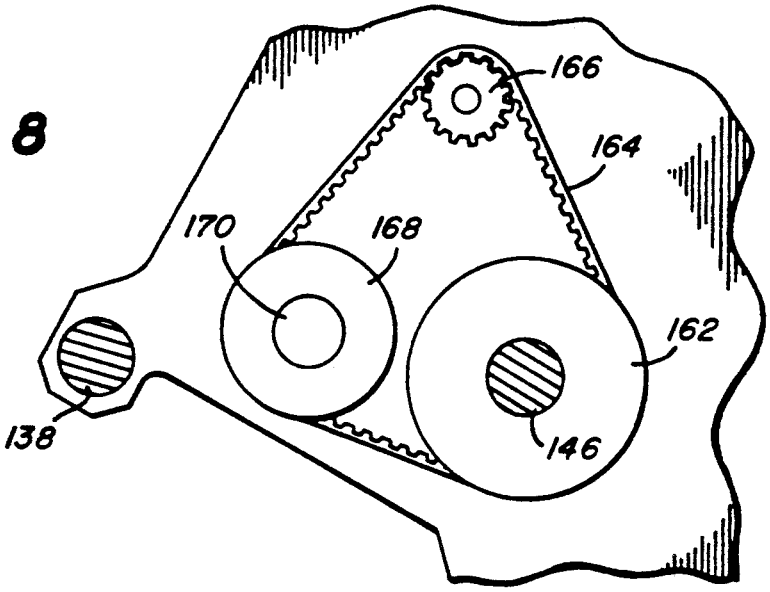
FIG. 8 shows a view taken along line 8—8 of FIG. 6.

At the front side of center plate 134, shaft 146 fixedly supports a timing belt pulley 162, as shown in FIGS. 6 and 8, about which pulley a timing belt 164 extends into engagement with an idler pulley 166 and a further drive pulley 168 mounted on a shaft 170. Shaft 170 is journalled for rotation in center plate 134 and rear plate 136. The diameters of pulleys 162 and 168 are chosen so that shaft 170 will rotate faster than shaft 146, for a purpose soon to be discussed. Between center plate 134 and rear plate 132, shaft 170 fixedly supports a tape release drum 172 comprising a plurality of axially spaced disks with knurled peripheral surfaces having the general configuration shown in FIG. 14A. The knurling preferably is a 96 TPI straight knurl pattern with an included angle alpha for the knurl ridges of about 60 degrees. To the rear of release drum 172 shaft 170 also fixedly supports a knurled drive wheel 174 which engages and rotates applicator roller 130, as best seen in FIGS. 14 to 18. Drive wheel 174 is sized so that applicator roller 130 will have a peripheral velocity approximately ten per cent higher than that of release drum 172. Note, however, that the surface of applicator roller 130 is in close proximity to but does not contact the surface of release drum 172.

Referring particularly to FIGS. 6 and 9 to 13, it can be seen that between center plate 134 and rear plate 132, shaft 146 passes loosely through a carrier block return spring 176 having a fixed end 178 positioned against a stop pin 180 extending rearwardly from center plate 134, and a movable end 182 crimped over one edge of an essentially rectangular knife carrier block 184 mounted for free rotation on shaft 146. To the rear of carrier block 184, shaft 146 fixedly supports a ratchet wheel 186 and, further to the rear, fixedly supports a tape acquisition drum 188 comprising a plurality of axially spaced disks with knurled peripheral surfaces having the general configuration shown in FIG. 14B. The knurling is of the same general type as used for release drum 172, except that the ridges of the knurls are flattened, preferably having a circumferential width beta of about 0.0508 cm. The sizes of drive pulley 162, drive pulley 168, release drum 172 and acquisition drum 188 are chosen so that release drum 172 has a peripheral velocity approximately fifty per cent higher than that of acquisition drum 188. As shown in FIGS. 6 and 13, the disks of drums 172 and 188 are interleaved, for a purpose to be discussed.

Figure 9:
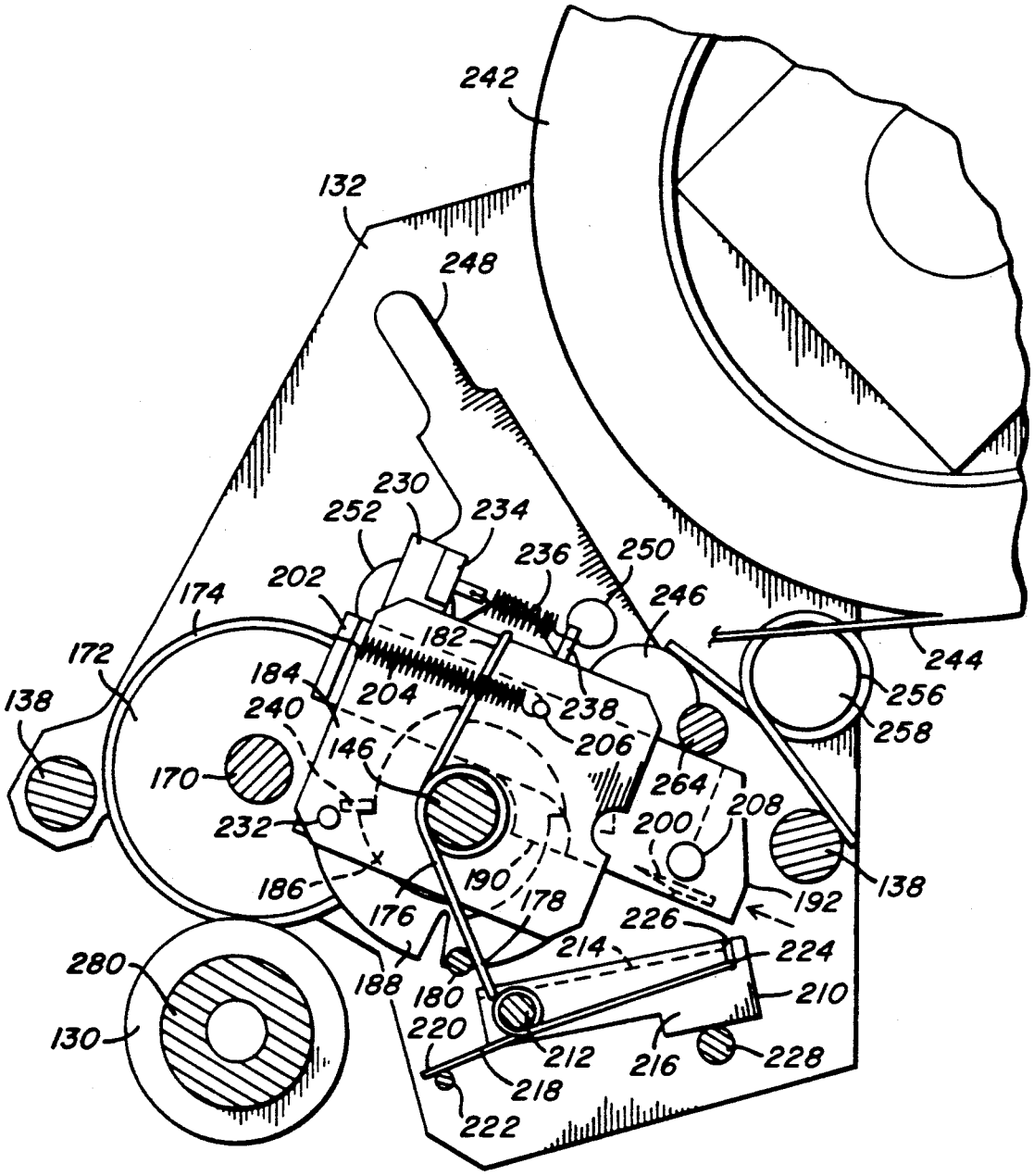
FIG. 9 shows a view taken along line 9—9 of FIG. 6, illustrating the plunge knife carrier in its fully withdrawn position.

As seen in FIG. 12 and in phantom in FIGS. 9 to 11, carrier block 184 includes on its rear side a transverse slot 190 in which a knife carrier plate 192 is slidably mounted and secured by keeper straps 194, 196. Knife carrier 192 includes at one end a rearwardly extending arm 198 on which a plunge knife 200, preferably pointed or arrow head shaped, is mounted. Knife carrier 192 also includes at its opposite end a forwardly projecting tab 202 which extends beyond the forward face of carrier block 184 and is attached to one end of a knife carrier return spring 204, the other end of which is attached to a pin 206 extending from the forward face of carrier block 184.

On the opposite side of knife carrier 192 from rearwardly extending arm 198 is provided a forwardly projecting cam follower pin 208 which cooperates with a flipper cam 210 pivotably mounted on a stub axle 212 extending rearwardly from center plate 134. Flipper cam 210 comprises a flat upper flange 214 extending rearwardly and a flat front flange 216 extending downwardly. A flipper cam return spring 218 is mounted on axle 212 with its fixed end 220 bearing against a stop pin 222 projecting rearwardly from center plate 134 and its movable end 224 captured in a slot 226 provided in the end of flipper cam 210 remote from axle 212. Downward movement of flipper cam 210 is limited by a stop pin 228 projecting rearwardly form center plate 134 just below slot 226.

Also attached to carrier block 184 is a knife carrier return pawl 230 having a pivot pin 232 extending rearwardly from carrier block 184. At its upper end, as best seen in FIGS. 9 to 13, pawl 230 includes a forwardly projecting tab 234 which extends into close proximity with the rear surface of center plate 134. A pawl return spring 236 is attached to tab 234 at one end, its other end being attached to a pin 238 projecting from one edge of carrier block 184. At a location closer to pivot pin 232, pawl 230 includes a rearwardly projecting dog 240 for engaging ratchet wheel 186.

Figure 15:
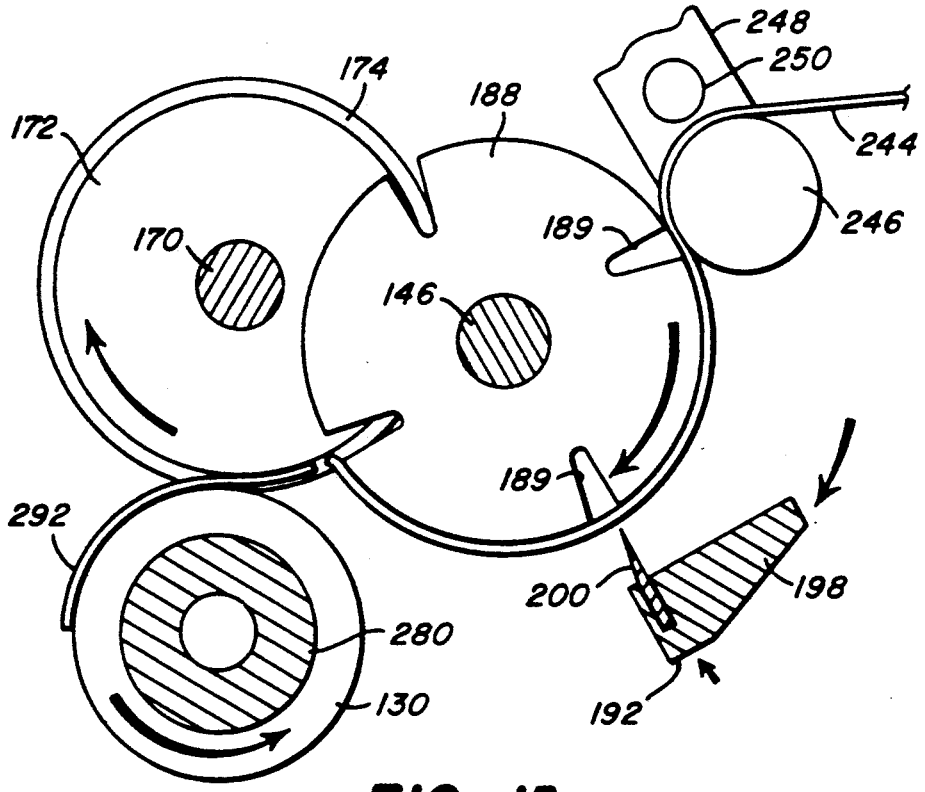
FIG. 15 shows a simplified view of the structure of FIG. 14, illustrating the plunge knife carrier in its partially inserted position.

Rear plate 132 includes an upwardly extending arm on which a source or spool 242 of single or double sided adhesive tape is mounted for rotation. As seen most clearly in FIGS. 14 to 16, a web 244 of tape of indeterminate length is led from spool 242 and passes, sticky side out, around a roller 246 mounted on a manually movable lever 248 pivoted to rear plate 132 on an axle 250. To thread web 244 into tape dispenser and applicator 130, lever 248 is depressed counterclockwise as viewed in FIG. 14 until a stop roller 252 mounted on a side arm 254 of lever 248 contacts acquisition drum 188. A return spring 256 is mounted on an axle 258 projecting forwardly from rear plate 132 and has its fixed end against one of spacers 138 and is movable end bearing on lever 248. With roller 246 raised from acquisition drum 188, web 244 is then passed around roller 246 as shown in FIG. 15 and lever 248 is released so that spring 256 presses roller 246 against web 244 whose sticky side then engages the flat tops 260 of the knurls on acquisition drum 188. Once web 244 has been thus engaged with acquisition drum 188, handle 148 shown in FIG. 7 may be indexed to rotate shaft 146 and cause drum 188 to rotate clockwise and draw more of web 244 from roll 242.

As shaft 146 rotates, whether under the influence of handle 148 or pneumatic motor 144, the various mechanisms associated with carrier block 184 complete their respective cycles. In the illustrated embodiment of the invention, each rotation of shaft 146 causes four cycles of operation of these mechanisms; however, those skilled in the art will appreciate that fewer or more cycles could be provided by changing the number of teeth on ratchet wheels 150 and 186. FIG. 9 shows the mechanism as it appears when a cycle of operation has just finished. As shaft 146 rotates clockwise, ratchet wheel 186 engages dog 240 on pawl 230 and thus pulls carrier block 184 along. As rotation continues, cam follower pin 208 on knife carrier 192 eventually comes into contact with the upper surface of flange 214 of flipper cam 210, thus causing knife carrier 192 to begin to move toward shaft 146 and bringing plunge knife blade 200 closer and closer to the periphery of acquisition drum 188.

Figure 16:
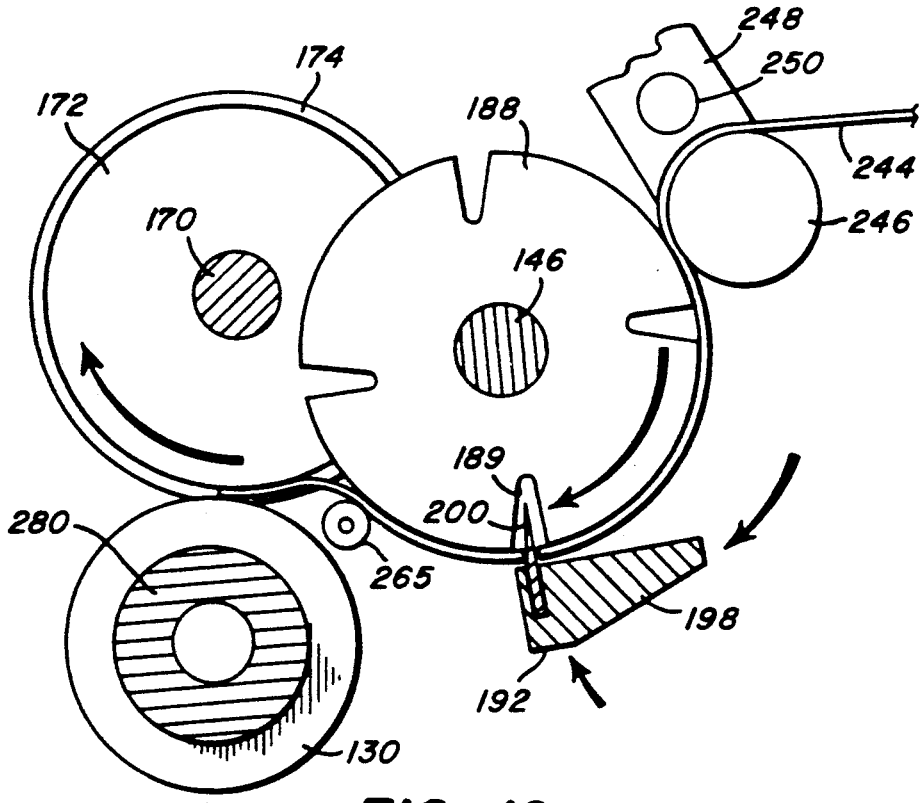
FIG. 16 shows a simplified view of the structure of FIG. 14, illustrating the plunge knife carrier in its fully inserted position.

As seen in FIGS. 14 to 16, acquisition drum 188 is provided with a plurality of inwardly extending slots 189, four in the illustrated embodiment, the slots extending axially along the drum through each of its constitutent disks. Plunge knife blade 200 is positioned to enter one of slots 189 as knife carrier 192 is forced toward shaft 146 by flipper cam 210. Slots 189 and plunge knife blade 200 preferably are angled slightly away from a radial orientation toward the axis of shaft 146, in the direction so that slots 189 open toward the rotation of shaft 146. This arrangement ensures that if web 244 were to adhere to the knife blade as the blade is extended into the slot, the leading portion of the web would strip from the blade. Conversely, when the blade is withdrawn from the slot in the manner now to be discussed, the trailing portion of the web would strip from the blade.

When the mechanism has reached the position of FIG. 11, plunge knife blade 200 has reached the position shown in FIG. 16. The grip of the adhesive on web 244 to flats 260 prevents the web from being drawn into slots 189 as it is being cut and results in clean, straight cuts. Moreover, the arrow head shape of knife blade 200 helps prevent the web from being drawn into the slots, as it significantly reduces the cutting force required. A small additional rotation of shaft 146 then causes cam follower pin 208 to slide off the end of flipper cam 210, thus allowing knife carrier 192 to retract knife blade 200 from slot 189 under the influence of spring 204. A small further rotation of shaft 146 causes tab 234 of pawl 230 to engage a stop pin 264 projecting rearwardly from center plate 134. Pawl 230 thus is lifted so that dog 240 comes out of engagement with ratchet wheel 186. This permits carrier block 184 to rotate counterclockwise under the influence of return spring 176 until the position of FIG. 9 is reached again and dog 240 has reengaged ratchet wheel under the influence of spring 236.

While carrier block 184 is returning to its start position, acquisition drum 188 and release drum 172 continue to rotate. Because of the very small area for adhesion to release drum 172 provided by the ridge lines 262 of its knurls, the sticky side of web 244 adheres very little to release drum 172 as its disks, interleaved with and having a higher peripheral velocity than those of acquisition drum 188, lift the leading edge of the strip of tape from drum 188 and guide that edge into the small radial clearance provided between release drum 172 and applicator roller 130, as shown in FIGS. 15 and 16. There, the still higher peripheral velocity of roller 130 and the vacuum acting at its surface combine to pull the strip from release drum 172. Of course, the distance along the periphery of release drum 172 from acquisition drum 188 to vacuum roller 130 must be substantially less than the desired length of the strips of tape being cut; so that, the trailing edge of each strip will still be adhered to acquisition drum 188 when its leading edge is acquired by vacuum roller 130, thus preventing the strip from peeling away prematurely. The differential adhesion of the web to drums 172 and 188, along with the peripheral velocity overspeed of release drum 172, prevents tape from adhering to release drum 172 and also allows acquisition drum 188 to control the squareness and advance of each cut stip from web 244.

Though the use of knurling on drums 172,188 is the preferred mode for establishing such differential adhesion and is effective for most useful types of adhesive tapes, a similar effect can be achieved by providing a radially spring biased roller 265 in contact with drum 188 just ahead of the point where drum 172 lifts the tape from drum 188. The location for such a roller is shown for illustrative purposes only in FIG. 16. By adjusting the tension on such a roller 265, the tape can readily be made to adhere more tenaciously to drum 188, in a manner similar to the differential adhesion achieved by flats 260 and ridges 262. It is also within the scope of the invention to use such a biased roller in combination with knurled or plain surfaces on the disks of acquisition drum 188 or release drum 172 or both.

While applicator roller 130 is positioned as shown in FIGS. 9 to 17, a hub 266 at its rear portion engages knurled wheel 174 to drive vacuum roller 130 approximately ten per cent faster than release drum 172. See FIG. 17 for the engagement of hub 266 and wheel 174. As indicated previously, applicator roller 130 is mounted for translation into and out of contact with the abutted ends of web positioned on process platen 100 and one of input platens 36, 38. For this purpose, a slide 268 is attached to the rear surface of front plate 136, within which slidable carrier 160 is mounted for movement between the two positions shown in FIGS. 17 and 18. A mounting block 270 is attached to the rear surface of carrier 160 and, in turn, supports a leaf spring mounting block 272 having parallel upper and lower surfaces from which a pair of leaf springs 274,276 extend toward release drum 172. Attached to the other ends of leaf springs 274,276 is a conventional bearing block and air fitting 278 which rotatably supports a shaft 280 for applicator roller 130. A vacuum connector 282 is attached to fitting 278 to provide the necessary vacuum for operation of applicator roller 130. A flange 284 extends rearwardly from the lower rear face of slide 268 and ends just below central plate 134. As shown in FIGS. 7, 17 and 18, flange 284 is provided in its rear face with a cam slot 286. Extending below and attached to bearing block 278 is an arm 288 rotatably supporting at its lower end a cam follower roller 290 which rides in cam slot 286. As shown in FIGS. 17 and 18, cam slot 286 slopes downwardly from the position of FIG. 17 in which hub 266 engages wheel 174 to the position of FIG. 18 in which applicator roller 130 moves across the surfaces of platens 100 and 36 or 38, indicated in phantom. Leaf springs 274,276 permit this movement of applicator roller 130 and, once roller 130 contacts platen 100, also provide a continuous downward bias to the roller to ensure that each strip of tape is securely applied to the abutted ends of webs 14 and 18, even if process platen 100 and one of input platens 36,38 are not positioned in precisely the same plane. And, because applicator roller 130 is covered with a compliant silicone rubber, it tends to move rather smoothly over small irregularities and misalignments.

The overall operation of the apparatus according to the invention should now be apparent to those skilled in the art. While the ends of the old and new webs are being trimmed and abutted using the apparatus of FIGS. 1 to 4, the tape dispenser and applicator or FIGS. 5 to 18 is actuated to advance the tape, cut a strip 292 as shown in FIGS. 1 and 15 and transfer strip 292 to vacuum roller 130. Cylinder 154 is then actuated to translate vacuum roller 130 from the position of FIG. 17 to that of FIG. 18 and then retract vacuum roller 130 to the position of FIG. 17 to receive the next cut strip of tape. Under the influence of leaf springs 274,276, the initial translation of vacuum roller 130 applies strip 292 across the abutted ends and the following retraction of vacuum roller 130 presses the strip again to ensure good adhesion.

Having thus described our invention in sufficient detail to enable those skilled in the art to make and use it, we claim as new and desire to secure Letters Patent for:

1. Apparatus for trimming the tail end of a first length of web and the lead end of a second length of web and for splicing such trimmed tail and lead ends together, comprising:

a first source of web of indeterminate length;

a second source of web of indeterminate length;

a first input platen for supporting web from said first source, said first platen having a first trailing edge;

a second input platen for supporting web from said second source, said second platen having a second trailing edge parallel to said first trailing edge;

means for selectively stopping movement of web from said first and second sources across said first and second platens;

a process platen positioned opposite said trailing edges;

means for relatively moving said platens between a first position in which said process platen receives web from said first platen and a second position in which said process platen receives web from said second platen:

means operable in each of said first and second positions for cutting at said trailing edges web extending from both said first and said second sources, respectively, past said first and second trailing edges;

whereby a trimmed lead end of web on one of said first and second platens alternately may be abutted with and spliced to a trimmed tail end of web on said process platen as said means for moving shifts said platens between said first and second positions after actuation of said means for cutting; and means for applying a strip of tape across such abutted tail and lead ends to splice them together.

2. Apparatus according to claim 1, wherein said means for applying a strip of tape comprises:

a source of adhesive tape of indeterminate length, said tape having at least one sticky side;

first rotatable drum means for drawing a web of such tape from said source with said sticky side contacting said first drum means;

means for cutting such web into strips of predetermined length while such web is being drawn by said first drum means;

second rotatable drum means for overcoming the adhesion of such strips to said first drum means and thereby removing such strips sequentially from said first drum means with said sticky side contacting said second drum means;

third rotatable drum means for removing such strips from said second drum means with said sticky side facing away from said third drum means; and means for translating said third drum means away from said second drum means and rolling said third drum means along said abutten trimmed tail and lead ends to apply such strips and splice said trimmed ends together.

3. Apparatus according to claim 2, wherein said first drum means comprises a first plurality of circular disks mounted for rotation on a first shaft; and said second drum means comprises a second plurality of circular disks mounted for rotation on a second shaft, the edges of the disks of said first plurality being interleaved with those of said second plurality, whereby such strips drawn by said disks of said first drum means are removed by said interleaved disks of said second drum means.

4. Apparatus according to claim 3, further comprising means for causing such web to adhere preferentially to said first drum means, relative to said second drum means.

5. Apparatus according to claim 4, wherein said means for causing comprises knurls with peripheral flats on said disks of said first drum means and knurls with peripheral ridges on said disks of said second drum means.

6. Apparatus according to claim 4, wherein said means for causing comprises a spring biased roller pressing said strips against said first drum means.

7. Apparatus according to claim 3, wherein the adhesive bearing side of such strips contacts the peripheral surfaces of at least a portion of the disks of said first and second drum means and the opposite side of such strips contacts the peripheral surface of said third drum means.

8. Apparatus according to claim 3, wherein said means for cutting comprises at least one slot extending from the peripheral surfaces of the disks of said first drum means toward said first shaft; at least one cutting blade; and means for plunging said blade into said at least one slot to form such strips as said first drum means rotates.

9. Apparatus according to claim 2, wherein said means for translating comprises a carriage for said third drum means; means for moving said carriage toward and away from said second drum means; and means for guiding said carriage during movement between a position in which said third drum means rotates in close proximity to said second drum means to receive such strips and a position in which said third drum means contacts such abutted trimmed tail and lead ends to splice them together.

10. Apparatus according to claim 8, further comprising a ratchet wheel mounted for rotation in synchronism with said first drum means; a knife carrier block mounted for rotation; spring means for biasing said carrier block against rotation in the direction of rotation of said ratchet wheel; pawl means mounted on said carrier block for engaging said ratchet wheel to cause said carrier block to rotate in the direction of said ratchet wheel against the bias of said spring means; wherein said means for plunging comprises means slidably mounted on said carrier block for supporting said cutting blade adjacent the periphery of said first drum means; and cam means for moving said means for supporting said cutting blade to cause said blade to enter said slot to cut such strips; and further comprising means for lifting said pawl means out of engagement with said ratchet wheel after each such strip has been cut, to permit said carrier block to counterrotate under the influence of said spring means until said pawl reengages said ratchet wheel and stops said carrier block in position to commence cutting the next such strip.

11. Apparatus according to claim 10, wherein said knife carrier block is mounted coaxially with said ratchet wheel.

12. Apparatus according to claim 10, further comprising means for causing such web to adhere preferentially to said first drum means, relative to said second drum means.

13. A method for splicing the tail end of a first length of web to the lead end of a second length of web, comprising the steps of:

providing a first source of web of indeterminate length;

providing a second source of web of indeterminate length;

providing a first input platen having a first trailing edge;

providing a second input platen having a second trailing edge parallel to said first trailing edge;

providing a process platen positioned opposite said first input platen;

moving web from said first source across said first input platen and said process platen;

positioning web from said second source across said second input platen with the end of said web extending past said second trailing edge;

stopping movement of said web from said first source;

while maintaining the positions of said input platens and said process platen, cutting at said trailing edges both of said webs from said first and second sources to produce as a result of said cutting a tail end from said first source on said process platen and a lead end from said second source on said second input platen;

following said cutting of both of said webs, relatively moving said process platen and said first and second input platens to abut said tail end with said lead end; and joining said tail end to said lead end to complete the splice.

14. A method according to claim 13, wherein said joining step comprises the steps of:

providing a source of adhesive tape of indeterminate length, said tape having at least one sticky side;

providing a first rotatable drum means;

drawing a web of such tape from said source by rotating said first drum means with said sticky side contacting said first drum means;

cutting such web to provide a strip of predetermined length while such web is being drawn by said first drum means;

providing a second rotatable drum means;

overcoming the adhesion of such strips to said first drum means and thereby removing such strip from said first drum means, by rotating said second drum means in proximity to said first drum means with said sticky side contacting said second drum means;

providing a rotatable vacuum drum means;

removing such strip from said second drum means by rotating said vacuum drum means in proximity to said second drum means with said sticky side facing away from said vacuum drum means; and translating said vacuum drum means away from said second drum means and rolling said vacuum drum means over said abutted tail end and lead end to apply such strip thereto to complete the splice.

* * * * *